US006478137B2

(12) United States Patent
Hebels et al.

(10) Patent No.: US 6,478,137 B2
(45) Date of Patent: Nov. 12, 2002

(54) METHOD OF AND APPARATUS FOR MANIPULATING TRAYS FOR CIGARETTES AND THE LIKE

(75) Inventors: Albert-Berend Hebels, Hamburg (DE); Matthias Horn, Ahrensburg (DE); Matthias Jobmann, Pinneberg (DE)

(73) Assignee: Hauni Maschinenbau AG, Hamburg (DE)

( * ) Notice: Subject to any disclaimer, the term of this patent is extended or adjusted under 35 U.S.C. 154(b) by 73 days.

(21) Appl. No.: 09/731,932

(22) Filed: Dec. 8, 2000

(65) Prior Publication Data

US 2001/0010284 A1 Aug. 2, 2001

(30) Foreign Application Priority Data

Dec. 8, 1999 (DE) ..... 199 59 061

(51) Int. Cl.[7] ..... B65G 37/00
(52) U.S. Cl. ..... 198/347.1; 198/347.4
(58) Field of Search ..... 198/347.1, 347.4; 414/331, 283, 403, 266, 268, 633

(56) References Cited

U.S. PATENT DOCUMENTS

| | | | | |
|---|---|---|---|---|
| 3,153,487 A | * | 10/1964 | Hoellen | 198/347.4 |
| 3,527,369 A | | 9/1970 | Bornfleth et al. | |
| 3,774,791 A | | 11/1973 | Bornfleth | |
| 3,974,007 A | | 8/1976 | Greve | 156/64 |
| 4,412,505 A | | 11/1983 | Haüsler et al. | 118/674 |
| 5,123,798 A | | 6/1992 | Glösmann et al. | 414/403 |
| 5,135,008 A | | 8/1992 | Oesterling et al. | 131/94 |
| 5,350,050 A | * | 9/1994 | Franke | 198/347.1 |
| 5,473,978 A | * | 12/1995 | Colombo | 198/347.1 X |
| 5,478,184 A | | 12/1995 | Bryant et al. | 414/331 |

FOREIGN PATENT DOCUMENTS

| | | |
|---|---|---|
| DE | 20 25 657 | 12/1971 |
| DE | 37 06 114 A1 | 8/1987 |
| DE | 39 17 097 | 11/1990 |
| GB | 2 218 066 | 11/1989 |

* cited by examiner

*Primary Examiner*—James R. Bidwell
(74) *Attorney, Agent, or Firm*—Venable; Robert Kinberg; Stuart I. Smith

(57) ABSTRACT

An apparatus is provided for manipulating trays for groups of rod-shaped articles which constitute or form part of smokers' products. The apparatus has a tray filling unit, a tray emptying unit including a magazine for filled trays, a source of empty trays, a predetermined storage facility for filled trays, a first conveyor, a second conveyor, and a device for transporting filled trays from the predetermined storage facility to the emptying unit. The first conveyor feeds a succession of empty trays from the source to the filling unit. The second conveyor feeds successive filled trays from the filling unit to the predetermined storage facility.

29 Claims, 1 Drawing Sheet

METHOD OF AND APPARATUS FOR MANIPULATING TRAYS FOR CIGARETTES AND THE LIKE

CROSS-REFERENCE TO RELATED CASES

This application claims the priority of the corresponding German patent application Ser. No. 199 59 061.3 filed Dec. 8, 1999. The disclosure of the aforesaid priority application, as well as the disclosure of each and every US and/or foreign patent and/or patent application identified in the specification of the present application, is incorporated herein by reference.

BACKGROUND OF THE INVENTION

The invention relates to improvements in methods of and apparatus for manipulating containers, and more particularly to improvements in methods of and in apparatus for manipulating containers of the type known as trays and often utilized for temporary storage of arrays or groups of rod-shaped articles such as plain or filter cigarettes, cigars, cigarillos, filter rod sections and other rod-shaped products of the tobacco processing industry.

Examples of rod-shaped articles which can be confined in containers (hereinafter called trays for short) of the type to which the present invention pertains are filter rod sections or filter mouthpieces which can be united with plain cigarettes, cigarillos, cigars or analogous rod-shaped tobacco-containing products to form therewith filter cigarettes, cigarillos, cigars or the like. Many types of filter mouthpieces contain a rod-like filler of acetate fibers and hardened droplets of a plasticizer which bonds portions of neighboring fibers to each other to thus establish a maze of paths for the flow of tobacco smoke from the lighted end, through the tobacco-containing part, through the filter mouthpiece and into the mouth of a smoker.

Heretofore known and presently utilized plasticizers (such as triacetin) for acetate fibers or the like require a certain period of time to set and to thus establish reliable bonds between neighboring portions of fibers in the mouthpiece of a filter cigarette or the like. Therefore, it is desirable to ensure that filter mouthpieces of unit length or multiple unit length which issue from a filter rod making machine remain unattached to plain cigarettes for certain intervals of time which are required by the plasticizer to set, i.e., which are needed to ensure that the appearance and/or other desirable characteristics of filter-tipped smokers' products are not affected during transport of filter mouthpieces into and/or during their treatment in a so-called tipping machine wherein plain cigarettes and filter mouthpieces of unit length or multiple-unit length are connected to each other by so-called uniting bands (e.g., webs of cigarette paper, imitation cork or the like) to form therewith filter cigarettes or analogous rod-shaped smokers' products.

Filter rod making machines which are of the type utilized for the making of continuous filter rods ready to be subdivided into filter rod sections of unit or multiple unit length are disclosed, for example, in U.S. Pat. No. 3,974,007 (granted Aug. 10, 1976 to Greve for "METHOD AND APPARATUS FOR THE PRODUCTION OF FILTER ROD SECTIONS OR THE LIKE") and in commonly owned U.S. Pat. No. 4,412,505 (granted Nov. 1, 1983 to Häusler et al. for "APPARATUS FOR APPLYING ATOMIZED LIQUID TO A RUNNING LAYER OF FILAMENTARY MATERIAL OR THE LIKE").

Filter tipping machines which can be utilized to unite filter rod sections with plain cigarettes are known under the name MAX-S (distributed by the assignee of the present application). Reference may also be had to commonly owned U.S. Pat. No. 5,135,008 granted Aug. 4, 1992 to Oesterling et al. for "METHOD OF AND APPARATUS FOR MAKING FILTER CIGARETTES".

The apparatus of the present invention can be utilized to transport filter rod sections between a filter rod making machine (such as that disclosed by Greve or by Häusler et al.) and a filter tipping machine (such as that disclosed by Oesterling et al.). Certain presently known transporting apparatus of such character are disclosed in commonly owned U.S. Pat. No. 5,123,798 granted January 23, 1992 to Glössmann et al. for "APPARATUS FOR MANIPULATING TRAYS FOR CIGARETTES AND THE LIKE". One presently utilized embodiment of the patented apparatus is designed to manipulate cigarettes, and more specifically to accept the surplus of cigarettes advancing in the form of a mass flow from a cigarette maker to a processing machine (such as a tipping machine of the type disclosed in the patent to Oesterling et al.) and to admit cigarettes into the mass flow when the requirements of the processing machine exceed the output of the maker. Such apparatus employs trays which are filled with cigarettes when the output of the maker exceeds the requirements of the processing machine and which are emptied into the mass flow when the need arises. The just described apparatus employs storage facilities for filled trays at one or more first levels and storage facilities for empty or emptied trays at one or more second levels. A transfer unit is provided to transport trays between various levels and, when necessary, to change the orientation of the trays.

It is also known to employ pneumatic conveyor systems as a means for transporting filter rod sections from a filter rod maker to a filter tipping machine (such as the aforementioned MAX-S machine). As a. rule, a pneumatic conveyor employs a receiving station with magazines which contain supplies of filter rod sections and cooperate with pneumatic senders which propel filter rod sections to the magazine of a filter tipping machine. Such apparatus are rather complex, bulky and expensive because they must be provided with special feeders for admission of filter rod sections into the senders and with special transfer units which advance filter rod sections from the senders into the magazine(s) of one or more tipping machines. On their way from the maker to the magazine of a filter tipping machine, the filter rod sections are subjected to repeated mechanical stressing which is bound or apt to affect their quality if it takes place prematurely, i.e., before the various constituents and/or ingredients of the filter rod sections are ready to withstand such stressing.

OBJECTS OF THE INVENTION

An object of the present invention is to provide a novel and improved method of manipulating filled and empty receptacles (such as the aforediscussed trays) for groups of rod-shaped articles of the tobacco processing industry in such a way that filled trays remain intact for periods of time which are required to optimize the quality of their contents prior to admission into the next processing station.

Another object of the invention is to provide a method which can be resorted to with particular advantage in connection with the manipulation of trays for rod-shaped products of the type that require a certain minimum interval of time to "ripen" or "age" starting with the instant of issuance from a maker and ending with the instant of admission into a processing machine or with the instant of undergoing mechanical stresses.

A further object of the invention is to provide a novel and improved method of manipulating filter mouthpieces for tobacco smoke between a filter rod making machine and a tipping machine wherein filter rod sections are united with plain cigarettes, cigars, cigarillos or the like to form therewith filter cigarettes, cigars or cigarillos of unit length or multiple unit length.

An additional object of the invention is to provide a method which renders it possible to optimally reconcile the need for adequate setting of certain hardenable substances in rod-shaped smokers' products and the requirements of modern high-speed processing machines or production lines wherein the rod-shaped products undergo further treatment or treatments such as uniting with other types of rod-shaped commodities, packing in containers (such as so-called soft packs and hinged-lid packs for plain or filter cigarettes) and/or others.

Still another object of the invention is to provide an apparatus for the practice of the above outlined method.

A further object of the invention is to provide a compact and relatively simple but highly versatile apparatus for the manipulation of empty, filled and emptied trays for groups of rod-shaped articles, such as filter rod sections, on their way from one or more makers to one or more processing stations.

Another object of the invention is to provide an apparatus which can select the periods of dwell of certain types of smokers' products in an economical time and space-saving manner.

An additional object of the present invention is to provide the apparatus with a novel and improved regulating system which renders it possible to prevent premature processing of rod-shaped articles while at the same time avoiding excessive periods of dwell of such articles prior to further processing.

SUMMARY OF THE INVENTION

One important feature of the present invention resides in the provision of a method of manipulating trays or analogous receptacles or containers (hereinafter called trays for short) for groups of rod-shaped articles, especially for stacks of parallel plain or filter cigarettes, cigars, cigarillos, filter rod sections or analogous smokers+ products. The improved method comprises the steps of filling successive empty trays at a filling station (e.g., at the discharge end of a filter rod making machine), transporting successive filled trays from the filling station to a predetermined storage facility (normally the first of two or more storage facilities for filled trays), monitoring the periods of dwell of filled trays at the predetermined facility (hereinafter called first facility for short), conveying filled trays from the first facility to a tray emptying or evacuating station (e.g., to the magazine of a filter tipping machine if the rod-shaped articles are filter rod sections or plain cigarettes), and regulating the timing of the conveying step as a function of the monitored periods of dwell of the filled trays at the first facility.

As a rule, the regulating step includes initiating the conveying of filled trays to the emptying station (either directly or through one or more additional storage facilities) when the respective monitored periods of dwell at least match a predetermined minimum period of dwell (e.g., a period of dwell which suffices to ensure that the aforediscussed plasticizer for acetate fibers of standard filter mouthpieces has set and/or that the adhesive for the overlapping seams of the tubular wrappers of filter mouthpieces can stand the treatment of filter mouthpieces in the tipping machine). The conveying step of such method preferably includes conveying filled trays from the first facility to the emptying station when the respective monitored periods of dwell at the first facility at least match the predetermined period of dwell.

The regulating step can include comparing the monitored periods of dwell with the predetermined minimum period of dwell and delaying the conveying step when the minimum period of dwell exceeds the monitored periods of dwell. The conveying step of such method can include advancing filled trays from the first facility to the emptying station along a first path when the respective monitored periods of dwell at least match the minimum period of dwell, and advancing filled trays along a longer second path when the minimum period of dwell exceeds the monitored periods of dwell.

The monitoring step can include establishing and assigning to each of the filled trays information denoting the time of entry into the first facility, and monitoring the assigned information on conveying of filled trays from the first facility to thus ascertain the periods of dwell of filled trays in the first facility.

The method can further comprise the steps of establishing a magazine for the delivery of filled trays received, for example, from the first facility to the emptying station within a predetermined interval of time, and the regulating step of such method can include ascertaining for each filled tray the sum of the respective monitored period of time and the predetermined interval; the conveying step of such method preferably includes advancing filled trays from the first facility directly into the magazine when the respective sums at least match the predetermined minimum period of time. Such method can further include the step of ascertaining for each filled tray the aforesaid predetermined interval of time; this further step can comprise establishing and assigning to each filled tray the information denoting the time of entry into the magazine, and monitoring the assigned information upon arrival of the respective filled tray at the emptying station to thus ascertain the predetermined interval of time.

The just described embodiment of the method can further comprise the step of advancing filled trays from the first facility to a second storage facility when the predetermined minimum period of dwell exceeds the respective sum. Such method can further comprise the step of advancing filled trays from a third storage facility to the magazine at the emptying station for at least some of the filled trays which are advanced from the first facility to the second facility. Still further, such method can include the steps of monitoring the periods of dwell of filled trays in the second facility, ascertaining for each filled tray at the second facility the sum total of the predetermined interval of time and the monitored periods of time at the first and second storage facilities, and conveying filled trays from the second facility to the magazine when the respective sums total at least match the predetermined maximum period of time. Each step of monitoring the period of dwell of a filled tray in the second storage facility can include establishing and assigning to each of the filled trays information denoting the time of entry into the second storage facility, and monitoring the assigned information on conveying the filled tray from the second facility to thus ascertain the period of dwell of the. filled tray at the second storage facility. Still further, such method can comprise the step of advancing filled trays from the second storage facility into a third storage facility upon ascertainment that the sum total of the predetermined interval of time and the respective monitored periods of time is less than the predetermined minimum interval or period of time.

The step of advancing filled trays from the second storage facility to the third storage facility can be carried out in automatic response to the ascertainment that the sum total of the predetermined interval of time and of the respective monitored periods of time is less than the aforementioned predetermined minimum period or interval of time.

Such method can further comprise the step of advancing filled trays from the second storage facility, along a preselected bypass route (e.g., by hand), and into the third storage facility upon completion of ascertainment that the sum total of the predetermined interval of time and the respective monitored periods of time is less than the predetermined minimum period of time.

The method can further comprise the steps of establishing a third storage facility for retention of each filled tray during a second interval of time, establishing for each filled tray in the second storage facility a second sum total of the second and predetermined intervals of time and the respective monitored periods of time, and conveying filled trays from the second storage facility directly into the third storage facility when the respective second sum total at least matches the predetermined minimum period of time.

The method can further comprise the steps of establishing a third storage facility for the retention of a filled trays during a second interval of timer establishing for each filled tray in the second storage facility a second sum total of the predetermined and second intervals of time and the respective monitored periods of time, and conveying filled trays from the second storage facility, along a time-consuming route, and into the third storage facility when the respective second sum total is less than the predetermined minimum period of time. Such method can further comprise the step of ascertaining the second interval of time for each filled tray in the third storage facility including establishing and assigning to each filled tray information denoting the time of entry of a filled tray into the third storage facility and monitoring the assigned information on conveying of the filled tray from the third storage facility to thus ascertain the second interval of time.

Another important feature of the invention resides in the provision of an apparatus for manipulating trays for groups of rod-shaped articles which constitute or form part of smokers' products. The improved apparatus comprises a tray filling unit, a tray emptying or evacuating unit including a magazine for filled trays a source of empty trays, a predetermined (first) storage facility for filled trays, a first conveyor which includes means for feeding a succession of empty trays from the source to the filling unit, a second conveyor which includes means for feeding successive filled trays from the filling unit to the first storage facility, and means for transporting filled trays from the first facility to the emptying unit. The transporting means includes means for monitoring intervals of dwell of successive filled trays in the magazine and/or in the first storage facility, and means for transferring filled trays from the first storage facility to the emptying unit along a path which is one of a plurality of different paths and which is selected in dependency upon the lengths or durations of monitored intervals of dwell of filled trays in the first storage facility and/or in the magazine.

The apparatus preferably further comprises means for regulating the operation of the transferring means; such regulating means includes means for comparing the monitored intervals of dwell with a predetermined minimum period of time. Such apparatus can further comprise a second storage facility which is arranged to receive filled trays from the first facility by way of the transferring means and to deliver filled trays to the magazine by way of the transferring means when the predetermined minimum period of time exceeds the monitored intervals of dwell. Still further, such apparatus can comprise a third storage facility for filled trays; the transferring means of such apparatus is preferably arranged to deliver filled trays from the third facility to the magazine.

The just described embodiment of the improved apparatus can further comprise means for effecting transfer of filled trays between the second and third storage facilities. The second and third storage facilities can be said to jointly provide a depository for filled trays being supplied by the transferring means from the first storage facility to the second or to the third facility and from the second or third facility to the magazine.

The trays art or can be provided with identifying indicia, and the monitoring means preferably includes sensors which can identify the trays on the basis of such indicia.

The first storage facility is or can be disposed at a first level, and the magazine can be disposed at a different second level.

The improved apparatus preferably further comprises a suitable receiver for emptied trays; the source of empty trays and the receiver for emptied trays are or can be disposed at different first and second levels, and the magazine and the first storage facility are preferably disposed at different third and fourth levels The (first) difference between the first and second levels can equal or approximate the (second) difference between the third and fourth levels The transferring means of such apparatus preferably includes an elevator having first and second tray conveying receptacles which are respectively disposed at fifth and sixth levels; the difference between the fifth and sixth levels preferably equals or approximates the first and/or the second difference.

The improved apparatus can further comprise a second source of empty trays; such second source and the aforementioned second storage facility for filled trays can be disposed at different first and second levels, and the first storage facility and the first mentioned source of empty trays can be disposed at different third and fourth levels. The aforementioned elevator of the tray transferring means can be set up in such a way that its first and second tray conveying receptacles are respectively disposed at fifth and sixth levels which are selected in a manner such that the difference between the fifth and sixth levels equals or approximates the difference between the first and second levels and/or the difference between the third and fourth levels. Such selection of various levels renders it possible to further speed up and automate the transfer of empty trays to the filling station, the transfer of emptied trays from the emptying station, the transfer of filled trays from the filling station, and the introduction of filled trays into the first, second or third storage facility and from a selected one of such storage facilities into the magazine at the emptying or evacuating station.

The manner in which empty trays are filled with arrays of preferably parallel rod-shaped articles of the tobacco processing industry and in which such articles are evacuated from filled trays is well known in the relevant art and forms no part of the present invention.

The novel features which are considered as characteristic of the invention are set forth in particular in the appended claims. The improved apparatus itself, however, both as to its construction and the modes of assembling, installing and operating the same, together with numerous additional important and advantageous features and attributes thereof, will be best understood upon perusal of the following detailed description of certain presently preferred specific embodiments with reference to the accompanying drawing.

BRIEF DESCRIPTION OF THE DRAWING

The single FIGURE of the drawing is a schematic elevational view of an apparatus with a tray filling unit, a tray emptying unit, two sources of empty trays, a depository for emptied trays, three storage facilities for filled trays, a magazine for filled trays at the emptying station, and an elevator which serves to transfer filled, empty and emptied trays between the aforementioned constituents of the improved apparatus in accordance with various embodiments of the improved method.

DESCRIPTION OF PREFERRED EMBODIMENTS

Figure 1:
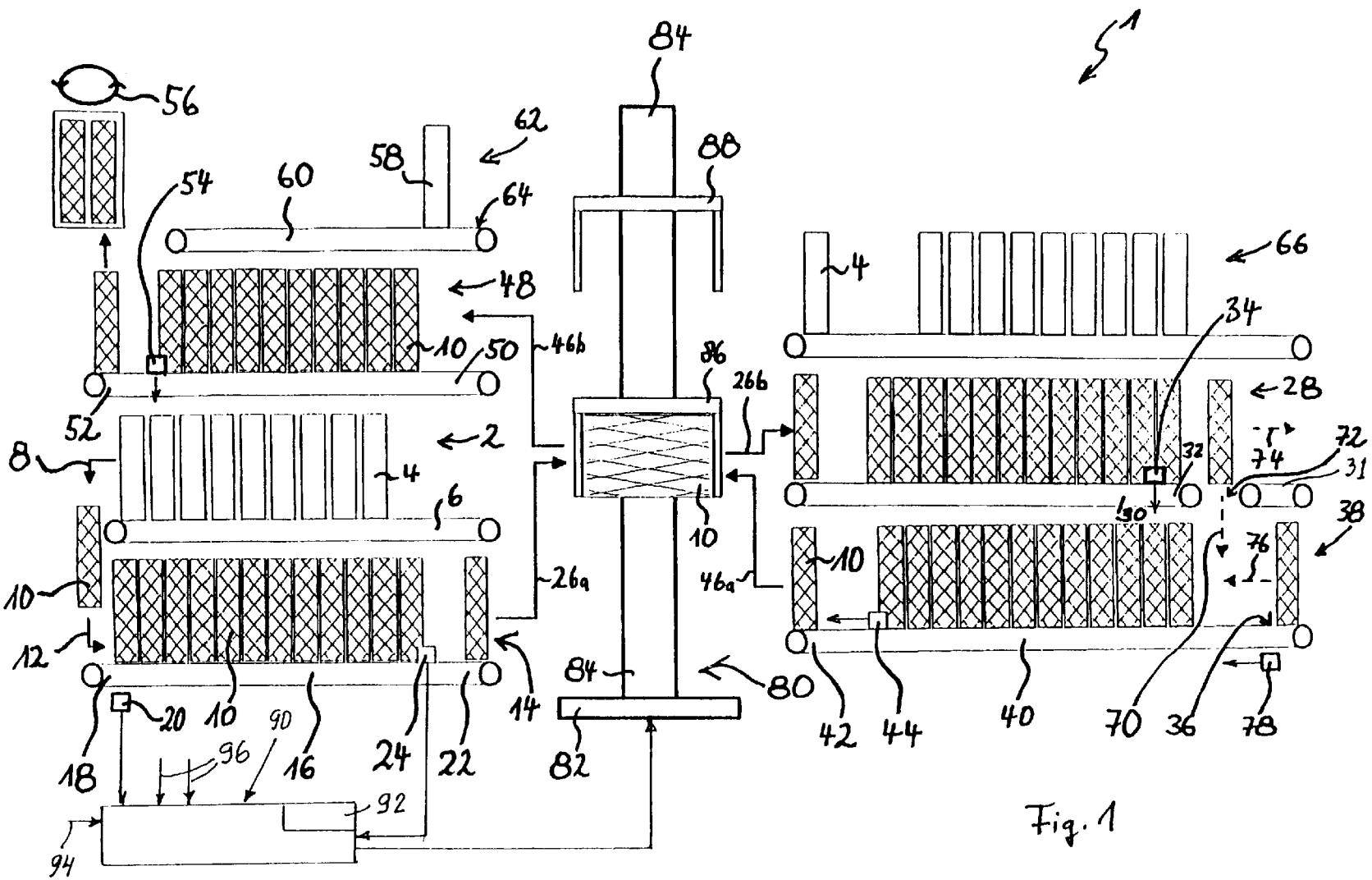

The apparatus 1 which is shown in the drawing constitutes a modification and a further development of the apparatus shown in the aforementioned commonly owned U.S. Pat. No. 5,123,798 to Glössmann et al. It serves to fill empty containers or trays 4 at a schematically indicated filling station 8, to temporarily store the thus obtained filled trays 10 in at least one of several storage facilities 14, 28, 38 and/or in a magazine 48, and to empty or evacuate filled trays 10 at one or more emptying stations (one shown at 56). The tray emptying unit at the station 56 can deliver the contents of successive filled trays 10 (issuing from the magazine 48) into the magazine or another suitable receptacle of a processing or consuming machine, not shown.

The apparatus 1 further comprises a tray transferring unit 80 which serves to convey empty trays 4 from a first source 2 to the filling unit at the station 8; to convey emptied trays 58 from the station 56 to a receiver 62; to transfer filled trays 10 from the (predetermined) first storage facility 14 to the second storage facility 28 or to the magazine 48, or from the third storage facility 38 to the magazine 48; and/or to convey empty trays 4 from a second source 66 to the first source 2.

The illustrated tray transferring unit 80 comprises an elevator including a pedestal 82, an upright guide 84 supported by the pedestal 82, and two vertically spaced apart receptacles or cages 86, 88 which can move with and/or relative to each other along and/or around the guide 84 to transport empty trays 4, emptied trays 58 and/or filled trays 10 in a manner to be described in requisite detail hereinafter.

The apparatus 1 further comprises a regulating unit 90 (e.g., a computerized control circuit) which serves to operate the transferring unit 80 as a function of several variables. One important function of the regulating unit 90 is to invariably ensure that a filled tray 10 can leave the outlet 52 of the magazine 48 for the emptying station 56 only when the contents of such filled tray are capable of withstanding deforming and/or other stresses which develop during emptying of trays 10 and during entry of the contents of such trays into the processing station (not shown) of a packing, tipping or other processing or consuming machine.

For example, if the filled trays 10 contain stacks of parallel filter rod sections of multiple unit length and the processing machine is a tipping machine of the type disclosed in U.S. Pat. No. 5,135,008 to Oesterling et al. or a MAX-S machine, the filter rod sections should remain in their respective trays 10 until after the plasticizer bonding portions of acetate fibers or the like has set. This requires a predetermined minimum interval or period of dwell the exact length or duration of which depends, for example, upon the nature of the plasticizer, the nature of fibers or filaments which are to be bonded to each other in the filter rod making machine, and/or upon the nature of treatment to which the filter rod sections are subjected during evacuation from the respective trays 10 and/or during admission into the magazine of a tipping machine. The arrow 94 indicates schematically an input which can receive one of a plurality of different signals each denoting the selected minimum acceptable period or interval of dwell of the contents of trays 10 in the apparatus 1, i.e., from the time of admission into an empty tray 4 at the filling station 8 to the time of evacuation from the respective tray 10 at the emptying station 56.

The manner in which rod-shaped articles of the tobacco processing industry can be stacked or otherwise grouped or arrayed in a filled tray is shown, for example, in FIG. 1 of U.S. Pat. No. 3,527,369 granted Sep. 8, 1970 to Bornfleth et al. for "APPARATUS FOR FEEDING ROD-SHAPED ARTICLES TO CONSUMING MACHINES". Furthermore, this patent describes and illustrates trays of the type adapted to be utilized in the apparatus 1 of the present invention as well as the manner in which the contents of filled trays can be emptied into the magazine of a consuming or processing machine, e.g., into a cigarette packing machine.

The source 2 of empty trays 4 comprises at least one endless belt or band or chain conveyor 6 having an upper reach or stretch which supports a row of upright empty trays 4 and can advance the foremost tray of such row into the filling station 8. The reference character 12 denotes an arrow which indicates the direction of movement of successive freshly filled trays 10. A conveyor (not shown) which transports successive freshly filled trays in the direction of arrow 12 delivers such trays onto the upper reach or stretch of an endless band, belt or chain conveyor 16 forming part of the (predetermined) first storage facility 14 for filled trays. The reference characters 18 and 22 respectively denote the inlet and the outlet of the storage facility 14. It will be noted that, in the illustrated apparatus 1, the source 2 of empty trays 4 is located at a level above the storage facility 14, that the conveyor 6 at the source 2 is set up to advance empty trays 4 in a direction to the left, and that the conveyor 16 in the storage facility 14 is set up to advance filled trays in the opposite direction.

The means for monitoring intervals of dwell of filled trays 10 in the storage facility 14 can be said to form part of the regulating unit 90 for the tray transferring unit 80 and includes a first sensor 20 at the inlet 18 and a second sensor 24 at the outlet 22 of the storage facility 14. These sensors transmit signals to the corresponding inputs of the regulating unit 90 (this is indicated by arrows) and the regulating unit ascertains the duration of interval of dwell of each filled tray 10 in the storage facility 14. Such signal is compared with the signal (arrow 94) denoting the minimum acceptable interval or period of dwell of a filled tray 10 at 14 prior to transfer (by the elevator 82, 84, 86, 88 of the unit 80) into the magazine 48 which has an endless belt, band or chain conveyor 50 serving to advance successive filled trays 10 to the emptying station 56. The receiving end of the conveyor 50 can accept filled trays 10 from the cage 86 or 88, and the outlet 52 of the magazine 48 can locate successive filled trays in positions for evacuation of their contents at the emptying station 56.

A sensor 54 at the outlet 52 of the magazine 48 is set up to transmit to the regulating unit 90 signals denoting the arrival of filled trays 10 at the emptying station 56. Furthermore, each sensor is or can be designed to decode information provided on the trays 4, and 58 and identifying the respective trays. The control circuitry of the regulating unit 90 can compute, on the basis of signals furnished by the sensors 20, 24 and 24, 54, the combined times of dwell of each filled tray 10 in the facility 14 and between the facility 14 and the emptying station 56.

The receiver 62 for emptied trays 58 has an endless belt or band or chain conveyor 60 which can advance successive emptied trays 58 from the emptying station 56 to the outlet 64 of the receiver 62 and hence into the range of the cage 88. The latter can transfer emptied trays 58 from the receiver 62 to the first source 2 or to the endless chain, belt or band conveyor of the second source 66 of empty trays 4. At least one of the cages 86, 88 can transfer empty trays 4 from the second source 66 to the first source 2.

The second storage facility 28 includes an endless belt, band or chain conveyor 30 having an upper stretch or reach which can receive filled trays 10 (via cage 86 or 88) to advance such filled trays in a direction to the right to the outlet 32 where the filled trays can be caused to descend onto the endless belt, band or chain conveyor 40 of the third storage facility 38.

Such transfer can take place along a shorter or direct route through a window or opening or chute 72 (see the arrow 70), or along a time-consuming longer route (e.g., by hand) as indicated by the arrows 74, 76.

A sensor 34 at the outlet 32 of the second storage facility 28 can transmit signals to the regulating unit 90 to report the departure of a particular filled tray 10 from the outlet 32 to the inlet 36 of the storage facility 38. The cage 86 can transfer filled trays 30 from the outlet 42 of the storage facility 38 as indicated schematically by arrow 46*a*. Sensors 78 and 44 at the inlet 36 and the outlet 42 of the storage facility 38 transmit to the regulating unit 90 signals respectively denoting the times of arrival of filled trays 10 from the storage facility 28 onto the conveyor 40 and the times of removal of filled trays from the conveyor 40.

The arrow 26*b* denotes the direction of transfer of filled trays 10 from the cage 86 or 88 into the storage facility 28; the arrow 26*a* denotes the direction of transfer of filled trays 10 from the storage facility 14 into the cage 86 or 88; and the arrow 46*b* denotes the direction of transfer of filled trays 10 from the cage 86 or 88 (i.e., from the storage facility 14 or 38) into the magazine 48.

The (preferably adjustable) difference between the levels of the cages 86, 88 can be selected in such a way that it matches or at least closely approximates the difference between the levels of the storage facility 14 and the magazine 48, the difference between the levels of the first source 2 of empty trays 4 and the receiver 62 for emptied trays 58, and/or the difference between the level of the second source 66 of empty trays 4 and the third storage facility 38. Other combinations are or can be equally advantageous, depending upon the program which is selected for the regulating unit 90 to carry out the transfer of empty trays 4 from the source 66 to the source 2, to carry out the transfer of emptied trays 58 from the receiver 62 to the source 2 or 66, and/or to carry out the transfer of filled trays 10 from the storage facility 14 to the storage facility 28 or to the magazine 48, from the storage facility 28 into the storage facility 38 and/or from the storage facility 38 into the magazine 48.

The sensor 20 can be set up in such a way that it assigns to the first filled tray 10 arriving from the filling station 8 a given natural number, e.g., the number 1. Successive filled trays 10 reaching the inlet 18 of the first storage facility 14 receive the next-following natural numbers 2, 3, 4, etc. At the same time, each of the filled trays 10 arriving at the inlet 18 of the storage facility 14 initiates the recording or memorizing of the time or instant of arrival; to this end, the regulating unit 90 embodies or is associated or cooperates with a suitable timer or clock 92. The thus obtained information is associated—via the assigned number—with the respective filled tray 10 as long as the tray remains filled, as long as it remains in the apparatus 1, or until it is converted into an emptied tray 58 and leaves the emptying station 56 for the receiver 62 or for the source 2.

The just described mode of associating each filled tray 10 with a natural number and with information pertaining to the instant of arrival into the range of the sensor 20 renders it possible to track the periods of dwell of successively filled trays in the apparatus 1, and especially (or exclusively) in that part of the apparatus which is designed for temporary storage of filled trays 10. The just discussed information associated with each filled tray can be said to denote or constitute a "time stamp" which is characteristic of the respective filled tray and distinguishes it from other filled trays in the apparatus 1.

It is preferred to provide the regulating unit 90 with additional inputs (two shown at 96) which serve to furnish additional information, such as the speed of the conveyor 6, 16, 50, 60, 30 and/or 40 (especially of the conveyors 6 and 16), the length(s) of the effective upper reach(es) of one or more conveyors 6, 16, etc., and/or information which can be processed by the circuitry of the regulating unit 90 to ensure accurate or adequate tracking of intervals of time spent by filled trays 10 in the apparatus 1 between the instant of arrival into the range of the sensor 20 and the instant of arrival into the range of the sensor 54.

The sensor 24 monitors the outlet 22 of the conveyor 16 for the arrival of successive filled trays 10 which are ready to leave the first storage facility 14 for the magazine 48 or for the second storage facility 28, always by way of the elevator including the cages 86 and 88. Signals from the sensor 24 are compared with the signals from the sensor 20, and this enables the circuitry of the regulating unit 90 to ascertain whether the filled tray 10 at the outlet 22 of the conveyor 16 and first storage facility 14 has already spent the required predetermined minimum interval or period of time or will spend not less than such minimum period of time not later than upon arrival at the sensor 54 along the shortest route, i.e., as indicated in the drawing by the arrows 26*a*, 46*b* plus the minimum interval of time required to advance with the upper reach of the conveyor 50 from the cage 86 or 88 into the range of the sensor 54.

On the other hand, if the time already spent in the storage facility 14 plus the shortest interval of time required to advance a filled tray from the range of the sensor 24 into the range of the sensor 54 is less than the required predetermined minimum period of time, the regulating unit 90 causes the transferring unit 80 to move the filled tray 10 from the outlet 22 along the route denoted by the arrows 26*a* and 26*b*, i.e., into the second storage facility 28.

A filled tray 10 which reaches the outlet 32 of the second storage facility 28 enters the range of the sensor 34 which transmits to the regulating unit 90 a signal denoting the time of arrival of each filled tray to a position for rapid or delayed (time-consuming) transfer into the third storage facility 38. The signal which is furnished by the sensor 34 enables the regulating unit 90 to ascertain for the filled tray 10 at the outlet 32 the total time (sum total of time) spent for the transport of such filled tray from the sensor 20 to the sensor 24 and from the sensor 24 (via elevator 82, 84, 86, 88 of the transferring unit 80) to the sensor 34. If the thus ascertained sum total of intervals at least equals the required predetermined minimum period of time (or if the sum total plus the time spent for the most expeditious transport of a filled tray from the sensor 34, through the storage facility 38 and via elevator (arrows 46*a*, 46*b*) to and through the magazine 48 into the range of the sensor 54 is sufficient to match or exceed the predetermined minimum period of time), the transfer of filled tray 10 from the outlet 32 onto the conveyor 40 takes place along the shorter route, namely through the window or chute 72 as indicated by the arrow 70.

It will be noted that the conveyor 30 establishes an unidirectional path or route from the elevator of the transferring unit 80 to the outlet 32, and that the conveyor 40 establishes an unidirectional path or route in the opposite direction.

The provision of the sensor 54 at the outlet of the magazine 48 can be said to constitute a safety feature because, as a rule, a signal from the sensor 54 merely confirms to the regulating unit 90 that the time spent (in the apparatus 1) by the filled tray 10 entering the range of the emptying station 56 at least matches the predetermined minimum interval or period of time.

The signal from the sensor 44 to the corresponding input of the regulating unit 90 is important if the signal from the sensor 34 indicates that the time spent by a filled tray 10 on its way from the filling station 8 (and more specifically from the sensor 20) to the sensor 34 plus the shortest interval of time required to advance a filled tray from the sensor 34 to the sensor 54 is less than the prescribed (predetermined) minimum period of time.

Another (and perhaps more important) function of signals furnished by the sensor 54 to the regulating unit 90 is to initiate the generation of a warning (alarm) signal or at least a stoppage of the conveyor 50 when the processing of a signal from the sensor 54 enables the circuitry of the unit 90 to ascertain that the filled tray 10 at the outlet 52 of the magazine 48 failed to spend in the apparatus 1 a period of time which at least matches the aforementioned predetermined minimum period. The alarm signal warns the attendant(s) that a corrective undertaking is in order. For example, the attendant(s) can decide to permit a first prematurely arrived filled tray 10 to enter the emptying station 56 nevertheless (e.g., because the predetermined minimum interval or period of time selected at 94 includes a safety interval) but to arrest the apparatus 1 (or certain parts of the apparatus) if the prematurely arrived filled tray is followed by one or more additional prematurely arrived filled trays.

As a rule (and as already mentioned hereinbefore), the signals which are transmitted by the sensor 54 merely confirm that the filled tray 10 at the outlet 52 of the magazine 48 has spent in the apparatus a sufficient interval of time to guarantee proper further processing of the contents. This enables the conveyor 50 to immediately introduce the filled tray 10 into the emptying station 56, e.g., without a stoppage or a slowdown at or ahead of the inlet to the station 56.

A freshly emptied tray 58 is caused to descend or is pushed or pulled onto the conveyor 60 of the receiver 62; such emptied tray 58 is thereupon delivered into the first source 2 or into the second source 66. For example, the arrangement can be such that the regulating and transferring units 90, 80 cooperate to normally deliver emptied trays 58 from the receiver 62 into the first source 2 but to supplement or replace such replenishing of the supply 2 with delivery of empty trays 4 from the second source 66 if and when the need arises.

The chute or window 72 can be established by providing the second storage facility 28 with an auxiliary conveyor 31; the chute is then located between the upper reaches or stretches of the conveyors 30 and 31. The transfer of one or more filled trays from the storage facility 28, through the window or chute 72, and to the inlet 36 of the storage facility 38 can be effected automatically by resorting to a platform which is symbolically represented by the arrow 70 and is movable up and down between the levels of the upper reaches of the conveyors 30 and 40. Such automatic transfer can take place when the signal furnished by the sensor 34 and processed in the regulating unit 90 indicates that the shortest possible dwell of a filled tray 10 being monitored at 34 in the storage facility 28 suffices to meet the selected minimum period of dwell.

If the mobile platform denoted by the arrow 70 is omitted (but preferably in addition to such platform), the apparatus 1 can be set up for manual transfer of filled trays 10 along a longer or relatively long route or path (i.e., in a time-consuming manner) which is indicated by the arrows 74 and 76. It goes without saying that each manual transfer (or at least some manual transfers) in the directions indicated by the arrows 74 and 76 can involve a shorter- or longer-lasting temporary storage of filled trays 10 at a suitable location between the discharge end of the second storage facility 28 and the receiving end of the third storage facility 38.

The sensor 78 can serve several purposes. For example, this sensor can signal to the regulating unit 90 the time of arrival of a filled tray 10 from the storage facility 28 to the storage facility 38 so that the unit 90 can calculate the interval of time spent by a filled tray on its way from the inlet 36 to the outlet 44, i.e., from the sensor 78 to the sensor 44. Alternatively, or in addition to such function, the sensor 78 can serve to perform the function of the sensor 20, namely to indicate the time of entry of a filled tray (a) from the storage facility 28 along the longer route indicated by the arrows 74, 76, (b) from the aforementioned location for temporary storage of filled trays 10 which were manually removed from the facility 28 (arrow 74) but were temporarily stored prior to being delivered onto conveyor 40 in the direction of arrow 76, or (c) from another source of filled trays (e.g., in the event of failure of the apparatus at the filling station 8 to deliver filled trays into the storage facility 14). In the latter event, each filled tray 10 admitted at the inlet 36 from an independent source (i.e., other than the filling station 8) is assigned a number and its time of entry is recorded in a manner as described hereinbefore in connection with the delivery of filled trays 10 from the filling station 8 into the range of the sensor 20.

The cages 86, 88 are or can be constructed, assembled and mounted on the upright guide 84 in such a way that they can move up and down with and/or relative to each other as well as that they can turn around the vertical axis of the guide 84. The lower cage 86 is shown in the process of carrying a filled tray 10; for example, such filled tray can be on its way from the storage facility 14 to the storage facility 28 (arrows 26*a*, 26*b*).

An advantage of the improved method and apparatus 1 is that they ensure the establishment of an optimal equilibrium or balance between the "ripening" of the contents of filled trays 10 on the one hand, and the output of the apparatus (i.e., the placing of a filled tray at the outlet 52 of the magazine 48 in accordance with the requirements of the consumer(s) receiving rod-shaped commodities from the emptying station 56) on the other hand. The provision of the sensors 20, 24 and of the means (90) for processing signals furnished by such sensors enable the signal evaluating means to decide, in good time, whether the filled trays can be dispatched from the outlet 22 of the first storage facility 14 directly to the magazine 48 or whether filled trays should reach the magazine 48 only after having advanced along a longer path leading at least through the storage facilities 28 and 38. Such decision can be reached by taking into consideration (in the regulating unit 90) the minimum length of the interval which elapses for the transport of a filled tray 10 from the outlet 22 of the first storage facility 14 to the outlet 52 of the magazine 48. If the rod-shaped articles in the filled trays 10 are standard filter rod sections of unit or multiple unit length, the minimum period of dwell (selected at 94) can be in the range of twenty minutes.

Of course, and as already explained hereinbefore, the minimum period of time can be selected (at 94 and/or at the inlet 36 of the storage facility 38) with a desired safety factor (i.e., in excess of twenty minutes if the filled trays 10 contain standard filter rod sections) and/or with another factor, depending upon the nature of the contents of the filled trays and/or the nature of treatment to which such contents are subjected at and/or downstream of the emptying station 56.

The provision of the sensor 54 exhibits the advantage that the regulating unit 90 can take into consideration variations of the periods of dwell of filled trays 10 in the magazine 48; such variations are or can be attributable to the frequency at which the conveyor 50 can or must deliver filled trays to the emptying station 56, i.e., to the extent to which the magazine 48 is filled with trays 10. Furthermore, and if the magazine 48 is filled with filled trays 10 and the tray evacuating instrumentalities at the emptying station 56 are operated at the anticipated normal speed (and if the extent to which the trays 10 are filled with rod-shaped commodities at least approximates a predetermined extent), the regulating unit 90 can determine the rate of delivery of filled trays 10 from the storage facility 14 and/or 28 in dependency upon a constant denoting the average period of dwell of a filled tray in the apparatus 1 on its way from the sensor 24 to the sensor 54.

As a rule, and especially if the rod-shaped articles are standard filter rod sections, the minimum period of dwell of the contents of a filled tray 10 can be in the range of 20 minutes, and the selected route of filled trays (from the storage facility 14 directly into the magazine 48 or along a much longer path including travel through the storage facilities 28 and 38) is selected in dependency upon the duration of travel from the sensor 20 to the sensor 24 plus the shortest interval which is required for travel of a tray from the sensor 24 to the sensor 54.

It is clear that the improved apparatus 1 can operate quite satisfactorily with only two storage facilities, such as 14 and 28. The provision of the additional storage facility 38 exhibits the advantage that the duration of travel of a filled tray 10 from the inlet 18 of the storage facility 14 to the magazine 48 can be lengthened in at least two different ways, i.e., by causing filled trays to advance from the storage facility 28 to the storage facility 38 through the window or chute 72 or along the path denoted by the arrows 74, 76. The third way involves temporary storage of filled trays 10 between the storage facilities 28 and 38. The length of the bypass route is determined (by the regulating unit 90) in dependency upon the duration of travel of a filled tray 10 from the filling station 8 to the sensor 24 plus the shortest possible interval of travel of a filled tray from the sensor 24 to the sensor 54, i.e., to the emptying station 56.

The regulating unit 90, the transporting unit 80 and the storage facilities 28, 38 can further serve as a means for preventing "starving" of the instrumentalities at the emptying station. Thus, if the storage facility 14 is unable to satisfy the requirements of the emptying station 56 (e.g., the momentary need of a tipping machine for filter rod sections), the regulating unit 90 can cause the elevator of the transferring unit 80 to deliver filled trays 10 from the storage facility 38 along the route indicated by the arrows 46*a* and 46*b*.

When the elevator of the transferring unit 80 is caused to deliver filled trays 10 from the storage facility 38, the signals from the regulating unit 90 to the elevator are selected by taking into consideration the period of dwell of a filled tray 10 in the storage facilities 28, 38 (or in the facility 38 if the inlet 36 receives filled trays from a source other than the storage facility 28) plus the shortest anticipated interval of travel of a filled tray from the outlet 42 to the outlet 52.

It is also possible to operate the apparatus 1 in such a way that a filled tray 10 is automatically transferred from the storage facility 38 into the magazine 48 whenever a filled tray leaving the first storage facility 14 is caused to. enter the second storage facility 28. Such mode of operation ensures that the magazine 48 invariably contains at least a preselected minimum number of filled trays. This automated mode of operating the apparatus 1 ensures that the consumer or consumers receiving rod-shaped articles from the emptying station 56 can always receive a necessary minimum number of rod-shaped articles as well as that all of the articles being evacuated from the respective trays are ready for further processing (e.g., that the plasticizer in the filter rod sections has set and the filter rod sections can stand all necessary further treatments).

The just described mode of operation is in contrast to that of presently known apparatus such as the apparatus disclosed in published German patent application No. 37 06 114. This application discloses apparatus wherein the rate of delivery of filter rod sections to the tray emptying station is decelerated if the plasticizer in the filter rod sections reaching the emptying station requires additional periods of time for adequate hardening or setting. The output of such conventional apparatus (and of the consumer(s) receiving filter rod sections from the emptying station) undergoes a pronounced (often drastic) reduction whenever the rate of feed of filled trays to the emptying station is reduced.

The storage facilities 28, 38 together constitute a substantially loop-shaped depository for filled trays 10. Such depository can be dimensioned and its constituents 28, 38 can be coupled to each other in such a way that, when necessary (e.g., in the event of temporary failure of instrumentalities at the filling station 8, of the conveyor 16 and/or of the sensors 20, 24), the period or interval of dwell of filled trays in the depository at least matches the predetermined minimum period of dwell selected at 94. Furthermore, such depository can ensure that the requirements of consumer(s) receiving rod-shaped articles from the emptying station 56 are met if such requirements exceed the ability of the first storage facility 14 to meet the requirements even at a time when the facility 14 is operated at a normal or maximum speed. Moreover,. and if the facilities 28, 38 receive filled trays 10 from the facility 14, the period of dwell of a filled tray on the conveyor 16 can be much shorter than the minimum period of dwell selected at 94.

The clock 92 can be selected and installed, in such a way that (a) the time which is assigned to each filled tray 10 arriving into the range of the sensor 20 is started at zero, or (b) that each freshly filled tray is associated with suitable information denoting the actual local time of the day. It is presently preferred to resort to the solution (b) this renders it possible to calculate various periods or intervals of dwell in a simple and reliable manner, i.e., the corresponding constituent(s) of the regulating unit 90 is or are called upon to simply establish a difference between the actual (local) time of arrival of a filled tray 10 into the range of the sensor 20 and the actual time(s) of arrival of such filled tray at the next-following sensor(s) 24, 54, 34, etc.

As already explained hereinbefore, the regulating unit 90 can further receive and process information pertaining to other factors which permit or facilitate a highly accurate determination of the period or interval of dwell of any filled tray 10 in the apparatus 1. The additional factors can include the speed of the conveyor(s) 16, 50, etc., the length(s) of the upper reach(es) of such conveyors, and/or others. Such mode of monitoring the advancement of filled trays 10 on their way to the emptying station 56 renders it possible to check the accuracy of information obtained by processing the signals transmitted by the selected sensors. The exact construction of the sensors forms no part of the present invention.

Any filled tray which is about to leave the storage facility 14 and (according to calculations carried out by the regulating unit 90) is likely to reach the emptying station 56 sooner than upon elapse of the predetermined minimum acceptable period or interval of time selected at 94 is simply transferred into the storage facility 28 and the unit 80 transfers a filled tray from the storage facility 38 into the magazine 48 along the route indicated by the arrows 46*a*, 46*b*.

The means for establishing and assigning information to each filled tray and for monitoring the assigned information can include a microprocessor or a computer.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of manipulating trays for rod-shaped articles of the tobacco processing industry and/or other rod-shaped articles and, therefore, such adaptations should and are intended to be comprehended within the meaning and range of equivalence of the appended claims.

What is claimed is:

1. A method of manipulating trays for groups of rod-shaped articles of the tobacco processing industry, comprising the steps of:

filling successive empty trays at a filling station;

transporting successive filled trays from the filling station to a predetermined storage facility;

monitoring the periods of dwell of filled trays at the predetermined storage facility;

conveying filled trays from the predetermined storage facility to a tray emptying station; and regulating the timing of said conveying step as a function of the monitored periods of dwell of filled trays at the predetermined storage facility, wherein said regulating step includes comparing the monitored periods of dwell with a predetermined minimum period of dwell, and delaying said conveying step when the predetermined minimum period of dwell exceeds the monitored periods of dwell, and wherein said conveying step includes advancing filled trays from the predetermined storage facility to the emptying station along a first path when the respective monitored periods of dwell at least match the predetermined minimum period of dwell and advancing filled trays along a longer second path when the predetermined minimum period of dwell exceeds the monitored period of dwell.

2. The method of claim 1, wherein said regulating step includes initiating the conveying of filled trays to the emptying station when the respective monitored periods of dwell at least match a predetermined minimum period of dwell.

3. The method of claim 2, wherein said conveying step includes conveying filled trays from the predetermined storage facility to the emptying station when the respective monitored periods of dwell at the predetermined storage facility at least match said predetermined minimum period of dwell.

4. The method of claim 1, wherein said monitoring step includes establishing and assigning to each filled tray information denoting the time of entry into the predetermined storage facility, and monitoring the assigned information on conveying of filled trays from the predetermined storage facility to thus ascertain the periods of dwell of filled trays in the predetermined storage facility.

5. A method of manipulating trays for groups of rod-shaped articles of the tobacco processing industry, comprising the steps of:

filling successive empty trays at a filling station;

transporting successive filled trays from the filling station to a predetermined storage facility;

monitoring the periods of dwell of filled trays at the predetermined storage facility;

conveying filled trays from the predetermined storage facility to a tray emptying station;

regulating the timing of said conveying step as a function of the monitored periods of dwell of filled trays at the predetermined storage facility; and establishing a magazine for the delivery of filled trays received from the predetermined storage facility to the emptying station within a predetermined interval of time, said regulating step including ascertaining for each filled tray the sum of the respective monitored period of time and said predetermined interval of time, and said conveying step including advancing filled trays from the predetermined storage facility directly into the magazine when the respective sums at least match a predetermined minimum period of time.

6. The method of claim 5, further comprising the step of ascertaining for each filled tray said predetermined interval of time, including establishing and assigning to each filled tray information denoting the time of entry into the magazine and monitoring the assigned information on arrival at the tray emptying station to thus obtain said predetermined interval of time.

7. The method of claim 5, further comprising the step of advancing filled trays from the predetermined storage facility to a second storage facility when the predetermined minimum period of dwell exceeds the respective sum.

8. The method of claim 7, further comprising the step of advancing filled trays from a third storage facility to the magazine for at least some of the filled trays which are advanced from the predetermined storage facility to the second storage facility.

9. The method of claim 7, further comprising the steps of monitoring the periods of dwell of filled trays in the second storage facility, ascertaining for each filled tray at the second storage facility the sum total of the predetermined interval of time and the monitored periods of time at the predetermined and second storage facilities, and conveying filled trays from the second storage facility directly to the magazine when the respective sums total at least match the predetermined minimum period of time.

10. The method of claim 9, wherein each step of monitoring the period of dwell of a filled tray in the second storage facility includes establishing and assigning to the filled tray information denoting the time of entry into the second storage facility and monitoring the assigned information on conveying the filled tray from the second storage facility to thus ascertain the period of dwell of the filled tray at the second storage facility.

11. The method of claim 9, further comprising the step of advancing filled trays from the second storage facility directly into a third storage facility upon ascertainment that the sum total of the predetermined interval of time and the respective monitored periods of time is less than the predetermined minimum interval of time.

12. The method of claim 11, wherein said step of advancing filled trays from the second storage facility to the third storage facility takes place in automatic response to ascertainment that the sum total of the predetermined interval of time and of the respective monitored periods of time is less than the predetermined minimum period of time.

13. The method of claim 9, further comprising the step of advancing filled trays from the second storage facility, along a bypass route, and into a third storage facility upon ascertainment that the sum total of the predetermined interval of time and the respective monitored periods of time is less than the predetermined minimum period of time.

14. The method of claim 9, further comprising the steps of establishing a third storage facility for retention of each filled tray during a second interval of time, establishing for each filled tray in the second storage facility a second sum total of the second and predetermined intervals of time and the respective monitored periods of time, and conveying filled trays from the second storage facility directly into the third storage facility when the respective second sum total at least matches the predetermined minimum period of time.

15. The method of claim 9, further comprising the steps of establishing a third storage facility for retention of filled trays during a second interval of time, establishing for each filled tray in the second storage facility a second sum total of the predetermined and second intervals of time and the respective monitored periods of time, and conveying filled trays from the second storage facility, along a time-consuming route, and into the third storage facility when the respective second sum total is less than the predetermined minimum period of time.

16. The method of claim 14, further comprising the step of ascertaining the second interval of time for each filled tray in the third storage facility including establishing and assigning to each filled tray information denoting the time of entering the third storage facility and monitoring the assigned information on conveying of the filled tray from the third storage facility to thus ascertain the second interval of time.

17. Apparatus for manipulating trays for groups of rod-shaped articles which constitute or form part of smokers' products, comprising:

a tray filling unit;

a tray emptying unit including a magazine for filled trays;

a source of empty trays;

a predetermined storage facility for filled trays;

a first conveyor having means for feeding a succession of empty trays from said source to said filling unit;

a second conveyor having means for feeding successive filled trays from the filling unit to the predetermined storage facility; and means for transporting filled trays from said predetermined storage facility to said emptying unit, including means for monitoring intervals of dwell of successive filled trays in at least one of the predetermined storage facility and the magazine, and means for transferring filled trays from said predetermined storage facility to the emptying unit along a selected one of a plurality of different paths in dependency upon the lengths of monitored intervals of dwell of filled trays at said at least one of said predetermined storage facility and said magazine.

18. The apparatus of claim 11, further comprising means for regulating the operation of said transferring means, including means for comparing said monitored intervals of dwell with a predetermined minimum period of time.

19. The apparatus of claim 18, further comprising a second storage facility arranged to receive filled trays from said predetermined storage facility by way of said transferring means and to deliver filled trays to said magazine by way of said transferring means when said predetermined minimum period of time exceeds said monitored intervals of dwell.

20. The apparatus of claim 19, further comprising a third storage facility for filled trays, said transferring means being arranged to deliver filled trays from said third storage facility to said magazine.

21. The apparatus of claim 20, further comprising means for effecting transfer of filled trays between said second and third storage facilities.

22. The apparatus of claim 21, wherein said second and third storage facilities jointly provide a depository for filled trays being supplied by said transferring means from said predetermined storage facility to at least one of said second and third storage facilities and from at least one of said second and third storage facilities to said magazine.

23. The apparatus of claim 18 for manipulating trays having identifying indicia, wherein said monitoring means includes sensors arranged to identify the trays and to render the trays distinguishable on the basis of the respective indicia.

24. The apparatus of claim 17, wherein said predetermined storage facility is disposed at a first level and said magazine is disposed at a different second level.

25. The apparatus of claim 17, further comprising a receiver for emptied trays, said source and said receiver being disposed at different first and second levels and said magazine and said predetermined storage facility being disposed at different third and fourth levels.

26. The apparatus of claim 25, wherein a first difference between said first and second levels at least approximates a second difference between said third and fourth levels.

27. The apparatus of claim 26, wherein said transferring means includes an elevator having first and second tray conveying receptacles respectively disposed at fifth and sixth levels, the difference between said fifth and sixth levels at least approximating at least one of said first and second differences.

28. The apparatus of claim 17, further comprising a second source of empty trays and a second storage facility for filled trays, said second source and said second storage facility being respectively disposed at different first and second levels and said predetermined storage facility and said first named source of empty trays being respectively disposed at different third and fourth levels.

29. The apparatus of claim 28, wherein said transferring means includes an elevator having first and second tray conveying receptacles respectively disposed at fifth and sixth levels, the difference between said fifth and sixth levels at least approximating at least one of (a) the difference between said first and second levels and (b) the difference between said third and fourth levels.

* * * * *